US005942016A

United States Patent [19]

Steinike

[11] Patent Number: 5,942,016

[45] Date of Patent: Aug. 24, 1999

[54] MOVING CLEANER

[76] Inventor: Ulrich I. Steinike, Herzogstandstrasse 2 d, Augsburg, Germany, D-86163

[21] Appl. No.: 08/930,364

[22] PCT Filed: Mar. 23, 1996

[86] PCT No.: PCT/EP96/01291

§ 371 Date: Sep. 23, 1997

§ 102(e) Date: Sep. 23, 1997

[87] PCT Pub. No.: WO96/30572

PCT Pub. Date: Oct. 3, 1996

[30] Foreign Application Priority Data

Mar. 24, 1995 [DE] Germany ..... 295 05 007
Mar. 24, 1995 [DE] Germany ..... 295 05 006

[51] Int. Cl.[6] ..... B08B 7/04

[52] U.S. Cl. ..... 55/290; 55/293; 55/302; 55/303

[58] Field of Search ..... 55/290, 302, 303, 55/293

[56] References Cited

U.S. PATENT DOCUMENTS

| | | | |
|---|---|---|---|
| 3,038,191 | 6/1962 | Black, Jr. . | |
| 3,628,313 | 12/1971 | Broadbent | 55/290 |
| 4,199,333 | 4/1980 | Ferri et al. | 55/290 |
| 4,243,397 | 1/1981 | Tokar et al. . | |
| 4,572,745 | 2/1986 | House . | |
| 5,143,529 | 9/1992 | Means, Jr. | 55/290 |
| 5,584,900 | 12/1996 | Zaiser et al. | 55/303 |
| 5,741,351 | 4/1998 | Beal et al. | 55/302 |

FOREIGN PATENT DOCUMENTS

| | | | |
|---|---|---|---|
| 1 916 343 | of 0000 | Germany . | |
| 331596 | 6/1966 | Germany . | |
| 1 230 538 | 12/1966 | Germany . | |
| 1 259 545 | 1/1968 | Germany . | |
| 16 19 882 | 2/1971 | Germany . | |
| 7128310 | 3/1973 | Germany . | |
| 24 02 805 | 7/1975 | Germany . | |
| 22 21 117 | 12/1975 | Germany . | |
| 16 85 860 | 3/1976 | Germany . | |
| 16 85 870 | 3/1976 | Germany . | |
| 26 25 559 | 12/1977 | Germany . | |
| 31 49 271 | 6/1983 | Germany . | |
| 33 21 565 | 12/1984 | Germany . | |
| 33 41 786 | 6/1985 | Germany . | |
| 33 42 689 | 6/1985 | Germany . | |
| 36 29 559 A1 | 3/1988 | Germany . | |
| 30 17 590 | 5/1988 | Germany . | |
| 37 27 143 | 2/1989 | Germany . | |
| 37 34 246 | 4/1989 | Germany . | |
| 39 19 875 | 12/1990 | Germany . | |
| 35 23 998 | 7/1992 | Germany . | |
| 42 17 411 | 12/1992 | Germany . | |
| 43 21 869 A1 | 1/1995 | Germany . | |
| 1317516 | 12/1989 | Japan | 55/290 |

*Primary Examiner*—Jay H. Woo
*Assistant Examiner*—Minh-Chau T. Pham
*Attorney, Agent, or Firm*—McGlew and Tuttle

[57] ABSTRACT

The invention relates to a travelling cleaner (1) for textile machines, in particular spinning and weaving machines, which has a blowing and sucking device (3) and also a filter device (4). The filter device (4) has a tubular filter cartridge with at least one lateral casing opening, via which the filter interior space is connected to the blowing and sucking device (3) by a lateral air connection (12). The casing opening (14) is formed as a longitudinally running, preferably I-shaped, slit. For cleaning the filter, a filter-cleaning apparatus (20) is provided, which travels axially over the filter casing (11) with a suction tube **(22*a*) and a plurality of blowing nozzles (23*a*)** and cleans it zone by zone with an intense air jet.

33 Claims, 11 Drawing Sheets

MOVING CLEANER

FIELD OF THE INVENTION

The invention relates to a travelling cleaner for textile machines, in particular spinning and weaving machines, having a blowing and sucking device and a filter device which has at least one tubular filter cartridge, which is connected via an air connection to the blowing and sucking device of the travelling cleaner

BACKGROUND OF THE INVENTION

Such a travelling cleaner is known in its basic construction from DE-B-16 85 860. It has a blowing and sucking device, with which fibers, yarn remains and similar residues can be blown off the textile machines and then sucked up. In a filter device, these residues are separated from the transporting air. The filter may be in the form of a filter mat.

In practice, it is also known to install tubular filter cartridges in such travelling cleaners. The filter is connected via an air connection to the blowing and sucking device, so that cleaned air is available for the blowing off of the residues. In the case of the known filter cartridges, the air connection is situated on the end face, whereby the contaminated air flows axially into the cartridge and leaves radially through the filter casing. The known arrangement has problems with the multiple air deflections in the blowing and sucking device and also in the filter and with the effectiveness of the filter device. In addition, this arrangement makes it difficult to clean the filter cartridge. The yarn finish and size cause the filters to clog relatively readily, which leads to short filter service lives and leads to frequent maintenance and cleaning of the filter.

DE-A-26 25 559 and DE-A-22 21 117 show travelling cleaners with drum filters, which are subjected to negative pressure by an internal suction connection. The air flows through the filter casing radially from outside into the drum and leaves again axially.

For cleaning the soiled filter, filter-cleaning apparatuses are used. Such an apparatus is known from DE-B-16 85 860. It has a suction-removal device which can be docked on the filter chamber and with which it is intended to suck off and remove the residues from the flat filter. To depressurize the filter in this case, an additional shutter underneath the filter is opened, via which shutter the fan of the cleaning apparatus can take in secondary air.

Instead of suction removal, it is also known from DE-B-16 85 870 to blow out a flat filter in counter-air flow into a collecting chamber. The counter-air is generated by a reversing of the fan or a changing of its direction of flow by means of shutter control. There is no separate suction-removal device here. In addition, the fan of the cleaning apparatus is used for cleaning the filter. The mechanics required are complex, susceptible to faults and complicated in both citations.

DE-A-43 21 869 shows a different filter-cleaning apparatus. The blowing device of the travelling cleaner takes in ambient air via a drum filter which is rotatingly mounted and driven. The filter-cleaning apparatus has a blowing device and a suction-removal device, which are arranged on opposite sides of the filter and together clean the filter with a counter-flow flushing. The blowing device of the filter-cleaning apparatus is fed by the fan of the travelling cleaner and has no pressure generator of its own. The filter-cleaning apparatus operates with relatively low blowing and sucking pressures, which are aimed at providing low pressures and approximately equal volumetric flows. The blowing and sucking nozzles of the cleaning apparatus are directed in the same direction. The filter serves only for cleaning the ambient air taken in for the blowing operation, which is laden relatively little with fiber fluff and other contaminants. Therefore, low blowing and sucking pressures and low flow rates suffice for filter cleaning. The much more contaminated suction-removal air, which the cleaning apparatus sucks off the factory floor and off the textile machines, is not passed over the said but is diverted directly into the fixed suction duct and is passed there to the external disposal device.

DE-A-36 29 559 discloses a further filter cleaning apparatus, which is referred to there as a dust extracting apparatus. The filter is funnel-shaped and is cleaned by stationary blowing nozzles arranged in the form of a ring at the inlet point. The blowing air swept along the filter walls in parallel is intended to detach the filter residues and take them along into a collecting shaft with depository. The cleaning apparatus is shut down during the filter-cleaning operation. For the filter cleaning, only a superficial blowing off or stripping off of the filter residues takes place, but no counterflushing of the filter walls.

DE-B-12 59 545 shows a similar filter-cleaning apparatus. The filter residues are blown off with compressed air along the plate-shaped filter and, if appropriate, sucked off with the same operative direction. Here too, no counter-flushing of the filter takes place. Rather, the clean-air side of the cleaning apparatus is closed by shutters.

DE-B-12 30 538 discloses a stationary filter-cleaning apparatus which comprises a receiving container with a blowing device, into which container the filter box or collecting container of a travelling cleaner can enter. The collecting box for the filter residues has a closeable shutter, which permits emptying. Fitted on the upper side of the collecting box is a flat filter. This is counter-flushed by compressed air by the blowing device of the filter-cleaning apparatus on entering into the receiving box. There is no sucking device operating together with the blowing device.

In practice, the effectiveness of the known filter-cleaning apparatuses has proved to be inadequate. The yarn finish and size lead to the filter being clogged by the residues and make their removal more difficult. The known suction-removal device often cannot detach the residues. The alternative blowing out of the filter has, on the other hand, the disadvantage that the residues are swirled in the collecting chamber and blown out again into the ambience. As a result, the cleaning effect on the textile machine is at least partially negated again. Although a reduction in the blowing intensity alleviates this disadvantage, on the other hand it has the consequence again of a reduced detachment of the residues from the filter. The result is that the known techniques lead to short filter service lives and cause frequent maintenance and exchanging of the filter.

SUMMARY AND OBJECTS OF THE INVENTION

It is the object of the present invention to overcome the filter problems as discussed above.

According to the invention, a travelling cleaner for textile machines, in particular spinning and weaving machines, is provided, having a blowing and sucking device and a filter device. The filter device has at least one tubular filter cartridge, which is connected via an air connection to the blowing and sucking device of the travelling cleaner. The filter cartridge has at least one casing opening, which can be connected to a lateral air connection.

As a result of the filter cartridge having at least one casing opening, which is connected to a lateral air connection, the transporting air laden with the residues flows radially into the filter cartridge and leaves again radially through the filter casing. The radial and more uniform action on the filter improves the filtering effect. Finer filter materials, which also hold back fine dusts, can be used. Furthermore, it is advantageous that the filter cartridge can be dimensioned and positioned in the filter chamber more favorably and can be adapted to requirements.

In addition, fewer deflections of the flow air and more favorable flow cross-sections can be achieved in the region of the blowing and sucking device of the travelling cleaner and of the filter, whereby the flow and swirl losses are reduced, residual deposits in the region of the blowing and sucking device are largely avoided and the effect of the filter device is additionally improved even more. Furthermore, this permits a reduction in the required suction power. The filtering effect is more uniform over the filter area, which increases the service life. The filter cartridge can be cleaned better and more effectively and can be disposed of better.

The filter cleaning can be performed by a filter cleaning apparatus having a suction-removal device and, if appropriate, a blowing device, which reach around the filter casing and are connected to a disposal device. As a result, the filter can be back-flushed and also dried with compressed air, liquids or other suitable media.

The combination of sucking and blowing action according to the invention achieves an optimum cleaning effect of the filter, even and in particular in the case of clogging. The residues are reliably detached from the filter, preferably in counter-flow, by the blowing device and are picked up by the suction-removal device, preferably directly at the filter, and are transported away dependably and without loss. This technique can be successfully used for all types and shapes of filter. The filter can be blown, back-flushed and also dried with compressed air, liquids or other suitable media. It is recommendable to make the blowing flow or the blowing pressure stronger than the suction-removal negative pressure. Preferably, the blowing side is designed for high detachment pressure with low volumetric flow and mass requirement and the suction side is designed for high volumetric flow with low suction negative pressure. For this purpose, connection of the blowing device to a dedicated powerful pressure-medium source is recommended. On the other hand, a plurality of suction-removal devices may be brought together and connected to one another and also to a common, and possibly more remote, disposal device for the filter residues.

Furthermore, it is favorable to blow the filter as far as possible over its entire area and uniformly and, for this purpose, to adapt the blowing device to the filter shape and also to make one or more intense blowing jet(s) with locally limited range of action travel over the filter surface in the manner of a zonal cleaning. The mobility allows the blowing device to be of a small and simple construction. Moreover, this allows the possibility of integrating the filter-cleaning apparatus into the travelling cleaner without adversely affecting the filtering effect.

For the cleaning effect it is favorable to screen the region swept over by the blowing device thereafter from the negative pressure normally prevailing in the filter chamber by a fixed or extendable covering. This also improves the effect of the suction-removal device, which may comprise a simple suction-removal connection on the filter chamber wall and does not itself have to cover or reach over the filter, although the latter is possible for optimizing the effect.

The filter-cleaning apparatus may be assigned internally or externally to the travelling cleaner in any desired way. It may, in particular, be independently movable and be adjusted up to the travelling cleaner in any desired suitable way. This makes possible installation at any desired points and in any desired number and also in annularly closed transporting sections of the travelling cleaner. As a result, filter cleaning can be carried out during the running around of the travelling cleaner and without moving onto special branch tracks or terminal sidings, the cleaning moreover still being possible as often as desired. In addition, this simplifies the structural complexity, because a plurality of filters can be cleaned one after the other by just one blowing and suction-removal device. A further advantage is that the filters can be directed in any way desired, lying transversely and horizontally, standing upright or arranged in some other way.

The filter-cleaning apparatus is particularly suited for the tubular filters according to the invention, but with appropriate adaptation can also be used advantageously in connection with other types of filter.

In the case of tubular filters or filter cartridges, the filter cleaning is performed with a suction tube and at least one blowing nozzle, arranged with radial spacing with respect to the suction tube, on carrying arms or a covering. Preferably, the suction tube is made to enter the filter cartridge and sucks off the residues from the inside. The arrangement of the blowing nozzles in the region of the suction tube mouth makes it possible to concentrate the flushing-air flow onto a relatively small region and suck off the detached filter residues immediately. The centering of the carrying arms provided with the blowing nozzles may be performed by a repulsion or air-cushion effect of the air flow and/or suitable supporting elements. These relative arrangements and designs can also be realized with different types of blowing and suction-removal device.

For the cleaning of the filter cartridge, the design of the latter according to the invention with a lateral mounting and, if appropriate with a lateral slit for radial filter through-flow is of particular advantage. It permits free end-face access for the filter-cleaning apparatus. In addition, the suction removal may also take place through the air connection.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
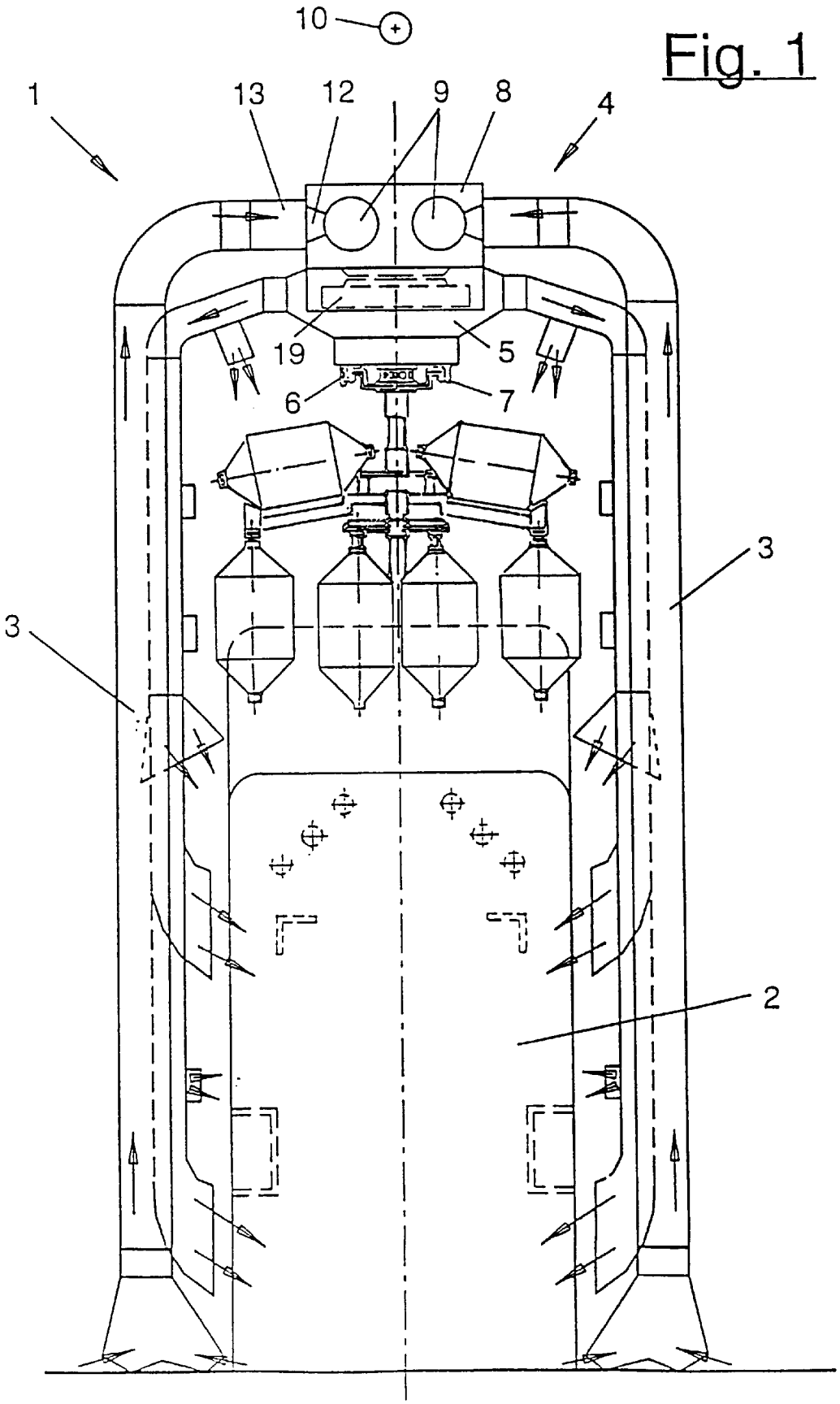
FIG. 1 is an end-on view of a travelling cleaner with a textile machine.
Figure 5:
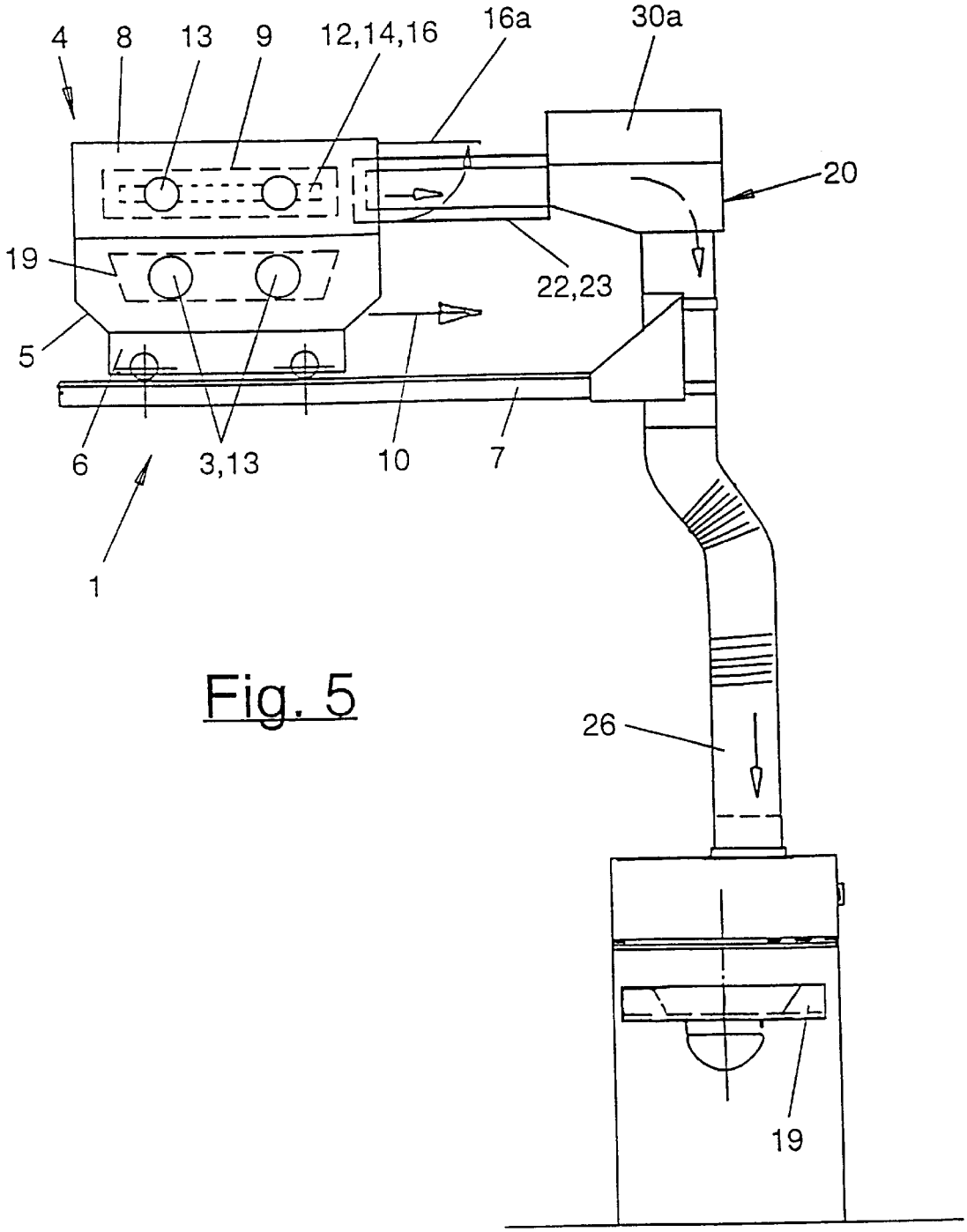
FIG. 5 is a side view of the travelling cleaner.

In FIGS. 1 and 5, a travelling cleaner 1 for textile machines, in particular spinning or weaving machines 2, is represented in end-on view and side view. FIG. 5 also shows an assigned filter-cleaning apparatus 20.

The travelling cleaner 1 has a blowing and sucking device 3 having a blower 19 and a plurality of lines or hoses 13 with nozzles, from which cleaning air is blown onto the spinning or weaving machine 2 and is sucked off again at another point. The travelling cleaner 1 is arranged relatively movably with respect to the spinning or weaving machines 2 arranged in one or more rows. Provided for this purpose is a suitable transporting device 6, which has, for example, an under-carriage which moves in the transporting direction 10 on rails 7 above the spinning or weaving machines 2. The travelling cleaner 1 has a housing 5, to which the blowing and sucking device 3 and the other units are connected. Within the scope of the components described above, the travelling cleaner 1 may be designed in any desired suitable way, for example corresponding to DE-B-16 85 860, DE-A-40 21 742 or the like.

The circulated cleaning air flow is freed of dust, fibers, yarn remains and other residues blown off the spinning or weaving machines 2 by means of a filter device 4. Provided for this purpose are one or more tubular filter cartridges 9, the casing 11 of which may have in cross-section preferably a circularly round, or—alternatively a polygonal shape. The filter cartridges 9 are arranged in a filter chamber 8, which is connected via shafts 30 to the lower-lying blower 19, which preferably generates a negative pressure in the filter chamber 8. The motor of the blower 19 may be arranged in the filter chamber 8.

The residue-laden cleaning air is passed from the sucking device 3 via air connections 12 to the filter cartridges 9. From the blower 19, the filtered cleaning air is conducted into the ducts of the blowing device 3.

The filter cartridges 9 are flowed through radially by the cleaning air. The filter casing 11 has one or more casing openings 14, which are connected to the laterally arranged air connection 12. One or more hoses 13, tubes or the like, leading to the blowing and sucking device 3, may be fastened to the air connection 12.

The casing openings 14 are preferably designed as narrow slits running in the direction of the longitudinal axis 10 of the cartridge. They may have end cross-slits and a corresponding I-shape, which permit a large opening width.

The slits may extend over the entire length of the filter cartridge 9 or only a partial region. The cleaning air passes through the casing openings 14 radially into the hollow interior space of the filter cartridge 9, where it is uniformly distributed and leaves again radially at the filter casing 11.

Figure 3:
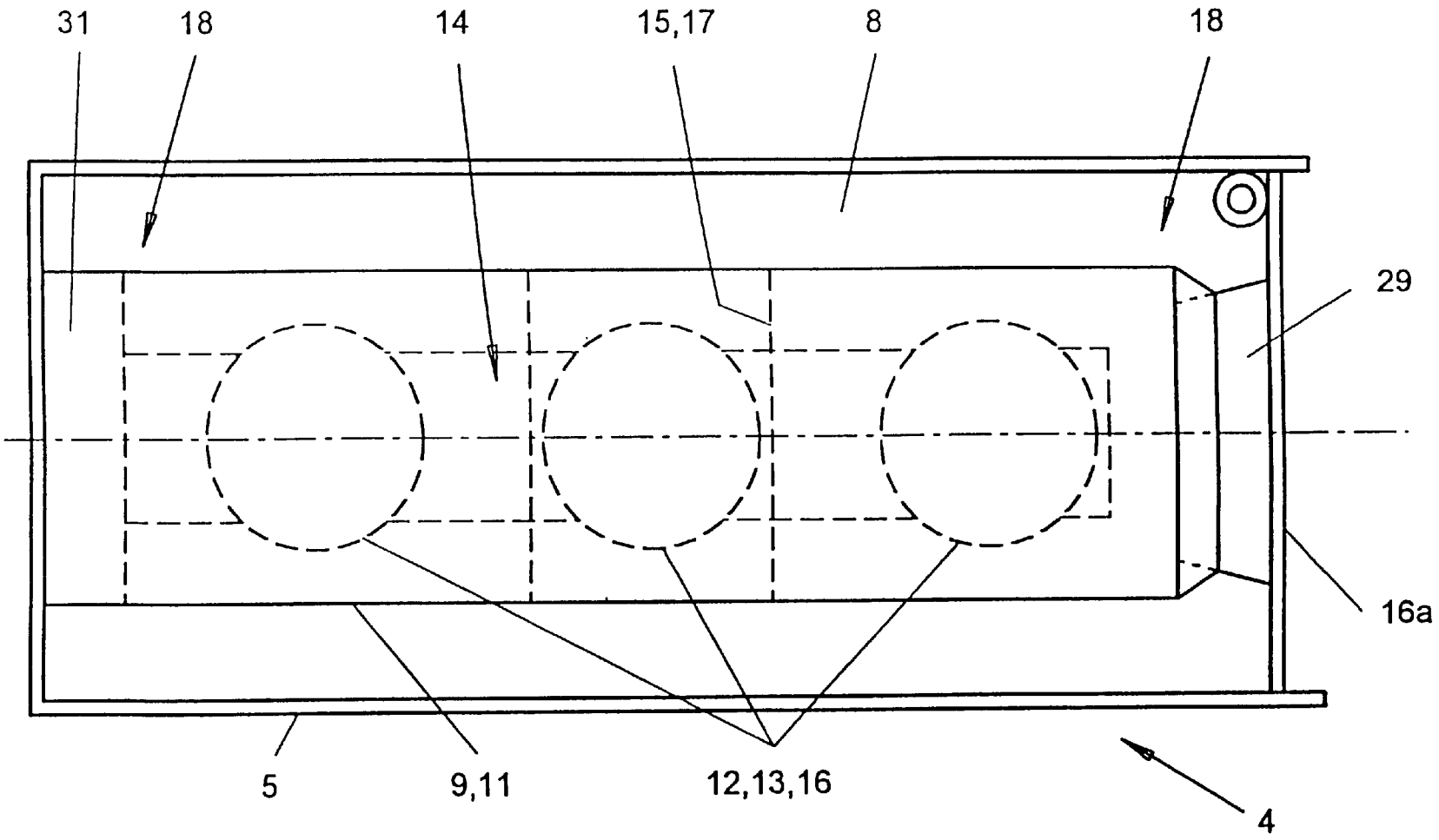
FIG. 3 is a side view of the filter cartridge in the filter chamber.

At the end faces 18, the filter cartridges 9 are preferably closeable. For this purpose, they may, for example, bear right up against the wall of the filter chamber 8 or else be clamped, drawn-on or otherwise arranged on a projecting wall attachment 31. FIG. 3 shows such an arrangement.

On an end face 18 there is also a movable closure 16*a*, for example a hinged shutter, a slide or the like, on the filter chamber wall. This closure serves on the one hand for exposing a large access opening for a—filter-cleaning apparatus 20, described below. The closure area or access area is in this case greater than the cross-section of the filter cartridge 9. On the other hand, on the closure 16*a* there may also be arranged an axially projecting, preferably conical shaped support 29, which engages with a form fit into the open end face 18 of the filter cartridge 9 and guides, supports and fixes it.

The filter cartridge 9 may consist of any desired suitable materials, for example foamed or fibrous materials. It is favorable if the filter cartridge 9 has a certain inherent dimensional stability. For this purpose, there may be built-in supporting elements not shown in rod or cage form or the like.

The air connection 12 has a funnel-shaped stub 16 which protrudes into the interior of the filter chamber 8 and reaches into the casing opening 14. The gaping edges of the casing opening 14 may be detachably fastened on the stub 16 by a suitable clamping mechanism 28. The width of the stub and the width of the slit of the gaping casing opening are, for example, about 35–70 mm. A large opening width and a large flow cross-section are favorable, because the required suction power of the blower 19 is reduced.

The air connection 12 is fastened on the wall of the filter chamber 8 and has on the outside a suitable fastening mechanism for the hoses 13 or other lines of the blowing and sucking device 3.

The fastening of the filter cartridge 9 is performed by means of one or more lateral mountings 15, which act on the filter casing 11 or on the built-in supporting elements. The mountings 15 preferably extend only over a partial length of the filter cartridges 9, so that they cover the filter area only in a small part and the end faces 18 of the filter cartridge 9 remain accessible. It is recommendable to arrange the mounting in the region of the casing opening 14 or of the air connection 12. The mounting 15 may be designed in any desired suitable way.

In the exemplary embodiment shown, it is fixedly connected to the wall of the filter chamber 8. It is formed by an annular supporting shell 17, which is adapted in shape to the filter cartridge 9 and is arranged in the interior space of the latter. The supporting shell 17 is detachably or fixedly connected to the inner edges of the stub 16. In the embodiment shown, the stub 16 is rigidly fastened to the wall of the filter chamber 8. The supporting shell 17 may be narrower than the stub 16. The filter cartridge 9 is slipped over the supporting shell 17 and the stub 16 by means of the casing opening 14.

Alternatively, the stub 16 or the supporting shell 17 may also be a component part of the filter cartridge 9 and be detachably fastened on the filter chamber wall by a clamping closure, a sliding guide or the like.

Figure 2:
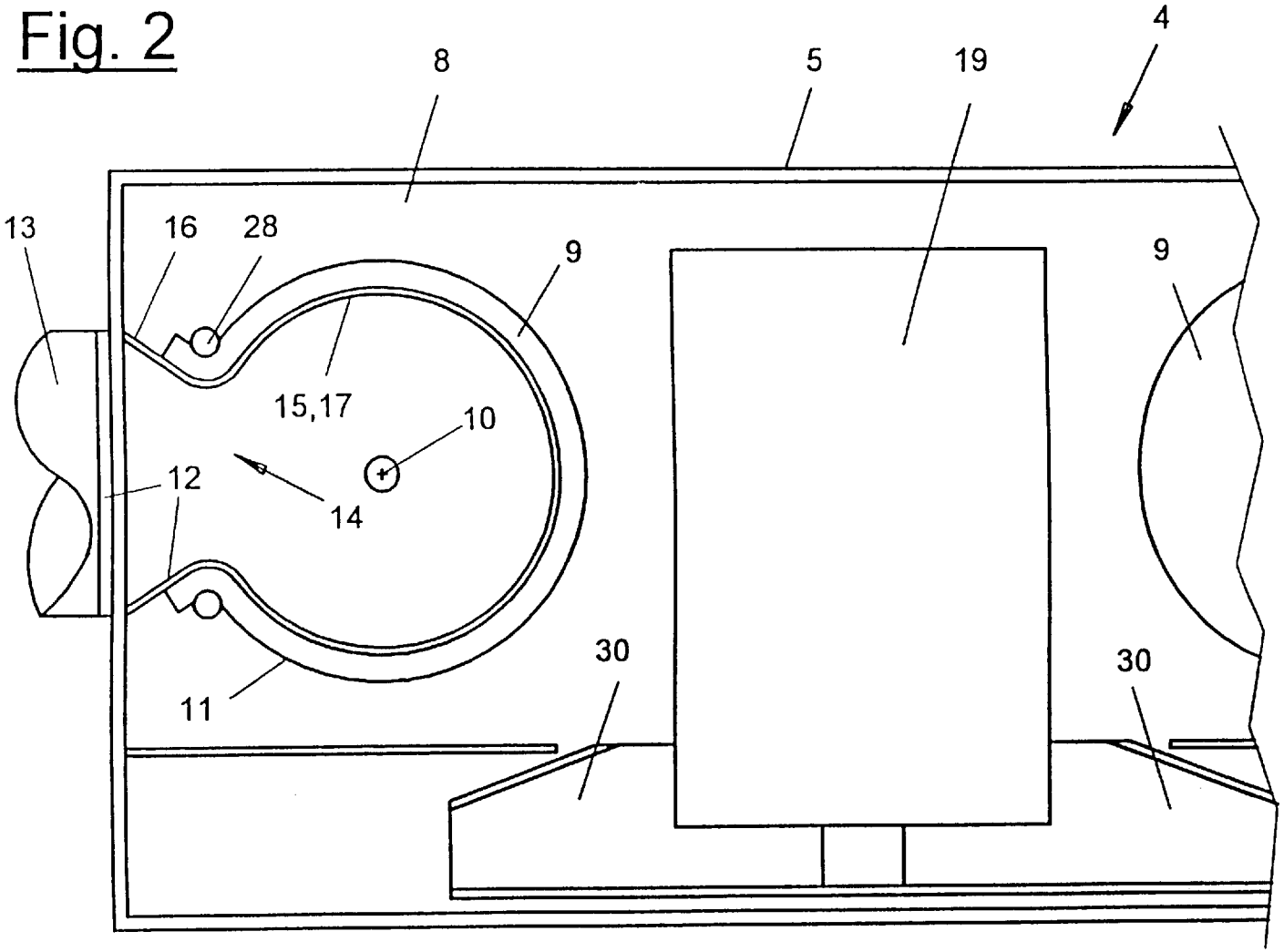
FIG. 2 is an enlarged and broken-away cross-sectional view through the filter chamber with the filter cartridge.

The supporting shell 17 supports the filter casing 11 from inside. As shown in FIG. 2, the slit edges of the casing opening 14 bear against the transition between stub 16 and supporting shell 17. Alternatively, the supporting shell 17 may also engage around and hold the filter cartridge 9 on the outside in the manner of a clip or the like.

The supporting shell 17 may be composed of a perforated metal sheet or of some other suitable permeable or impermeable material. In a modification of the embodiment shown, the supporting shell 17 may be interrupted in partial regions and comprise, for example, only relatively short attachments or clasps which adjoin the supporting edges. As a result, the filter casing 11 is uncovered on the side opposite the casing opening 14 and can be flowed through by the cleaning air.

For the fastening of the filter cartridges 9 on the mountings 15 there may be suitable clamping mechanisms 28, clamping elements or the like. However, securement is also possible by shape adaptation and inherent flexibility of the filter material. With correspondingly flexible filter material, the filter cartridge 9 may be formed in one piece and slipped over the mounting 15 or the supporting shell 17 and the stub 16 by means of the casing opening 14. Alternatively, it is also possible to divide the filter cartridge 9 and push the two halves axially onto the mounting 15. Both halves then have in each case a casing opening, which ends at the separating surface.

Figure 4:
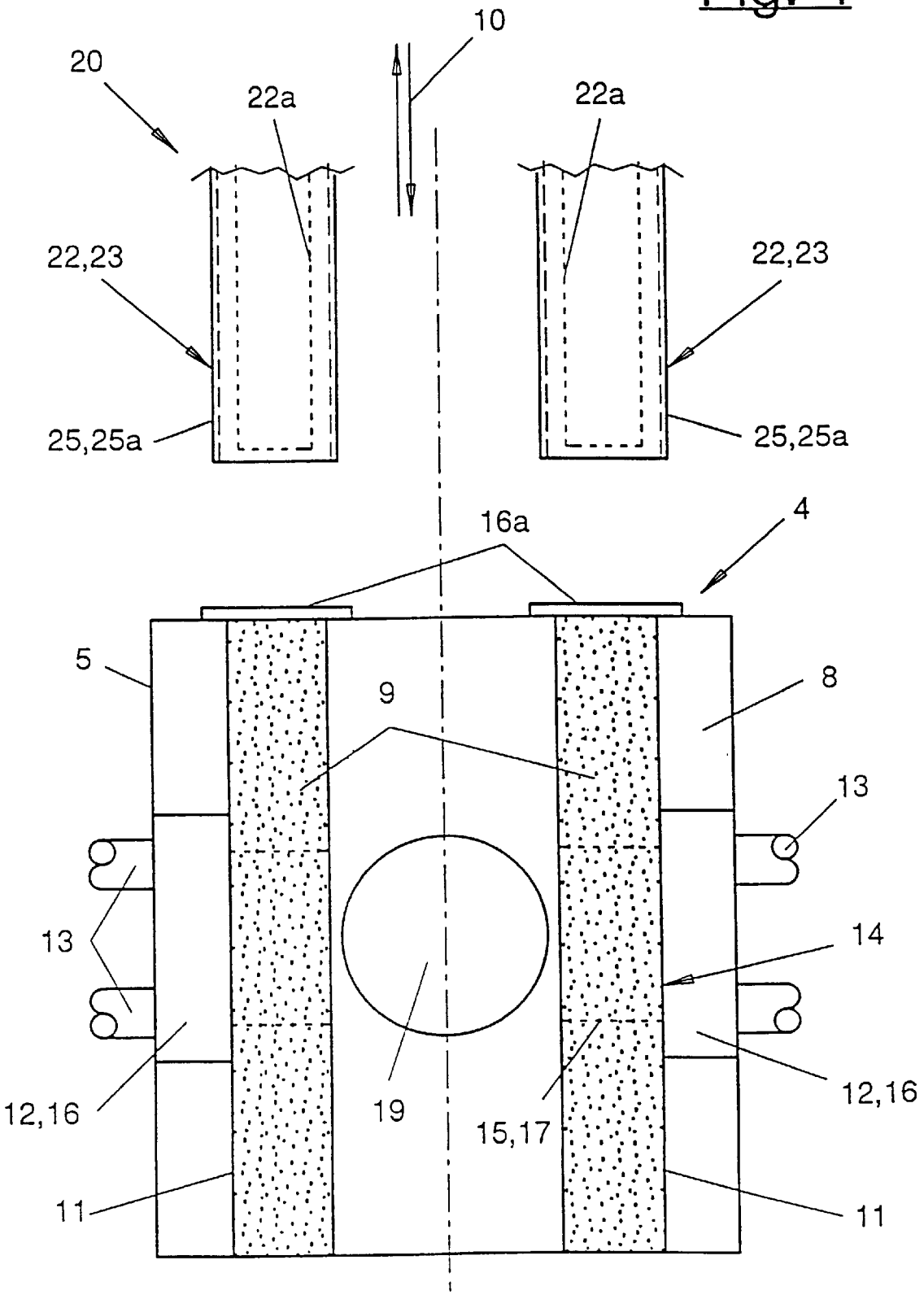
FIG. 4 is a plan view of the filter chamber.

As FIG. 4 clearly illustrates, in the filter chamber 8 there lie two filter cartridges 9 parallel next to each other with a spacing inbetween. They are aligned with their longitudinal axes in the transporting direction 10. As a result, the hoses 13 or lines of the blowing and sucking device 3 can be led directly from the side and without special air deflections to the air connections 12 and the filter cartridge 9. The connection may be performed horizontally or else from below. The arrangement shown is also favorable for the cleaning and disposal of the filter cartridge 9 with the filter-cleaning apparatus 20 described in more detail below.

As FIG. 5 clearly illustrates in side view and FIGS. 6 to 13 clearly illustrate in detail, arranged at the end of the rail 7 is a filter-cleaning apparatus 20. It has a blowing device 23 and a suction-removal device 22, which act on the filter 9 jointly and preferably on opposite sides. The blowing flow and the suction flow in this case act in the same direction, i.e. there is a consistent direction of flow.

The blowing device 23 is preferably arranged on the clean side and the suction-removal device 22 is preferably arranged on the soiled side of the filter 9, which as a result can be flushed and cleaned in counterflow. Both devices 22, 23 are arranged close to the filter 9 or can be brought up close to it. As a result, the detached residues or particles can be sucked off and removed directly at the filter 9. So-called overblowing is avoided.

In the exemplary embodiment represented, the filter-cleaning apparatus 20 is arranged externally. Alternatively, it may also be integrated into the travelling cleaner 1.

The blowing device 23 directs a strong fluid flow, preferably an air flow, onto the filter casing 11, which flow detaches the residues from the filter 9. With the suction-removal device 22, the detached particles are sucked off and fed to a connected disposal device 26. The blowing device 23 produces a high blowing pressure with a relatively low volumetric flow. The suction-removal device 22 conversely generates a relatively low suction negative pressure with a high volumetric flow. The pressure generators may differ correspondingly.

In the preferred embodiment, the blowing device 23 is connected to a dedicated compressed-air source 30*a*, for example a compressor, a compressed-air tank or the like, which is preferably of stationary arrangement. It generates a high pressure, which is preferably greater than the pressure which can be generated by the blower 19 in the travelling cleaner 1 and is, for example, 3 bar or more. The blowing positive pressure is stronger than the suction negative pressure, which may be, for example, around −0.5 bar. For this purpose, the suction-removal device 22 may have, for example, a radial-flow blower.

At least the blowing device 23 is adapted to the filter shape and preferably acts on the entire filter area. This may take place by a geometrical coverage of the filter area. In the preferred exemplary embodiment, the coverage is brought about by a blowing device 23 which has a small area and is moved in one or more axes in relation to the filter 9.

The suction-removal device 22 may likewise be adapted in shape to the filter 9. A preferably full area filter coverage is also provided here by the geometrical shape or by travelling over the filter area.

The suction-removal device 22 is connected individually or together with other suction-removal devices to the disposal device 26. In the simplest embodiment, the disposal device 26 may be a closeable collecting chamber. In the variant shown, the disposal device 26 has one or more collecting tubes and a separator for the separation of the particles and residues removed from the filter 9 from the flushing air. The flushing air is circulated, for example by a stationary blower 19, which is connected on the suction side to the suction-removal device 22 and generates there the suction negative pressure.

Alternatively, the blower 19 may be connected on the pressure side to the blowing device 23. Alternatively, the blower 19 of the travelling cleaner 1 may also be used, this blower, if suitably reversed, generating positive pressure in the filter chamber 8 and being able to replace or supplement the blowing device 23.

The blowing device 23 has one or more narrow blowing nozzles 23*a*, which direct an intense fluid jet onto the filter 9. The fluid jet preferably impinges on the filter area or the casing 11 transversely. If there are a plurality of individual blowing nozzles 23*a*, their areas of impingement on the filter 9 overlap. Slit nozzles are also possible.

In the exemplary embodiment of FIGS. 4 to 7, the suction-removal device 22 has a suction tube 22*a* extending in the transporting direction 10 and along the filter 9. The blowing device 23 has a plurality of annularly arranged individual blowing nozzles 23*a* or an annular slit nozzle. They are situated at the end of a likewise axially projecting tube-like covering 25*a* or of a plurality of projecting carrying arms 25. The covering 25*a* or the carrying arms 25, the blowing nozzles 23*a* and the suction tube 22*a* are arranged in parallel and with radial spacing with respect to one another, the suction tube 22*a* preferably being located on the inside. The spacing is matched to the thickness of the filter casing 11.

The blowing device 23 and suction-removal device 22 are aligned differently and essentially transversely with respect to each other. The blowing is performed transversely with respect to the filter area and the suction removal is performed essentially tangentially or along the filter area.

For the filter cleaning, the travelling cleaner 1 moves towards the filter-cleaning apparatus 20, the previously mentioned closure 16*a*, for example a hinged shutter, at the filter chamber 8 being opened and exposing the end openings 18 of the filter cartridges 9. The filter cartridges 9, preferably supported, in the central region by the mountings 15, are then accessible at the end faces, the suction tube 22*a* being able to enter into the cartridge interior space and the covering 25*a* or the carrying arms 25 with the blowing nozzles 23*a* reaching around the filter casing 11 on the outside. The closures 16*a* are in this case dimensioned to be of such a size that the inlet opening exposed by them in the housing wall is larger than the filter cartridge cross-section and permits the entering of the carrying arms 25 into the filter chamber 8.

Figure 6:
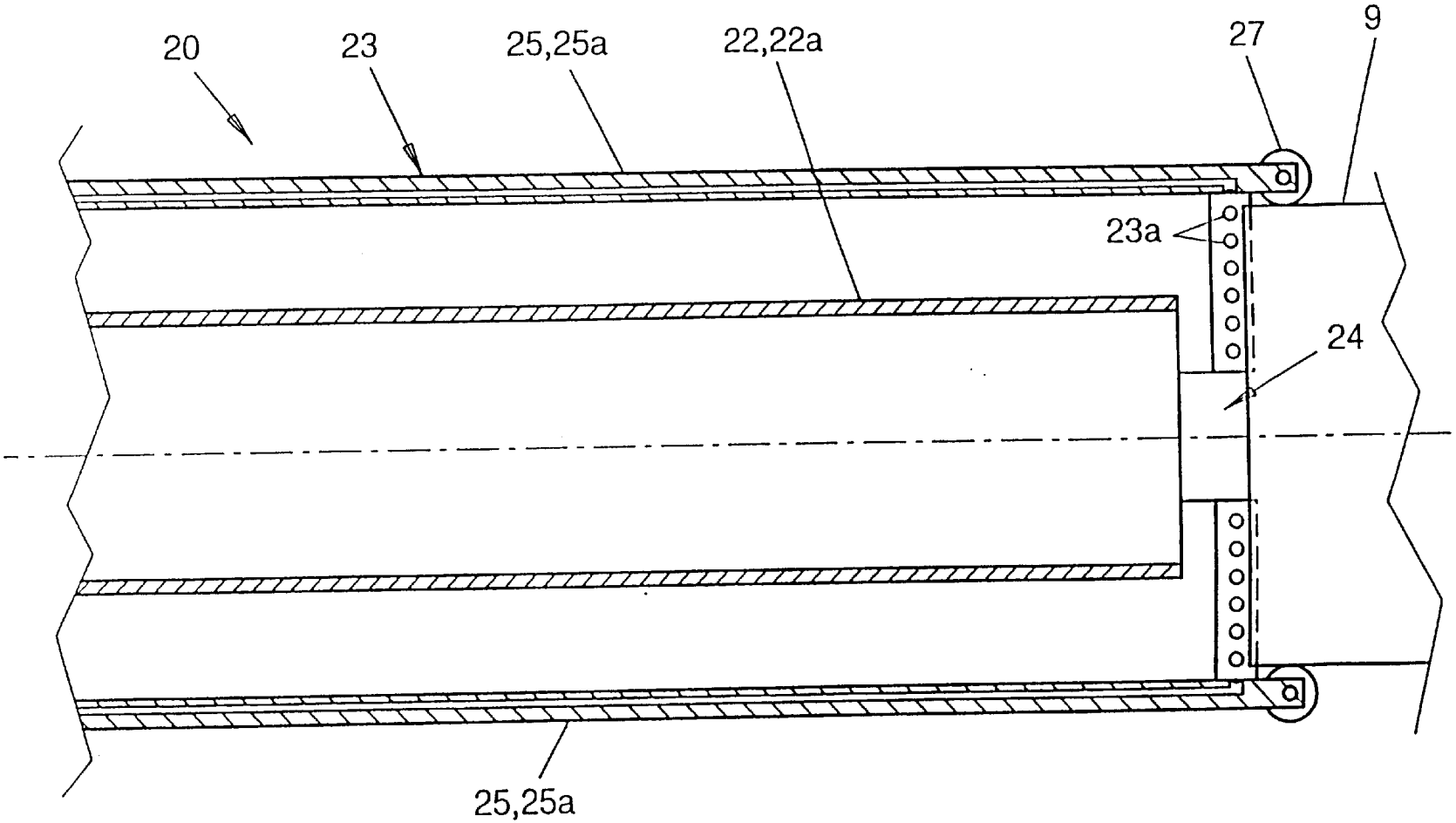
FIG. 6 is a broken-away and enlarged representation of the filter-cleaning apparatus.
Figure 7:
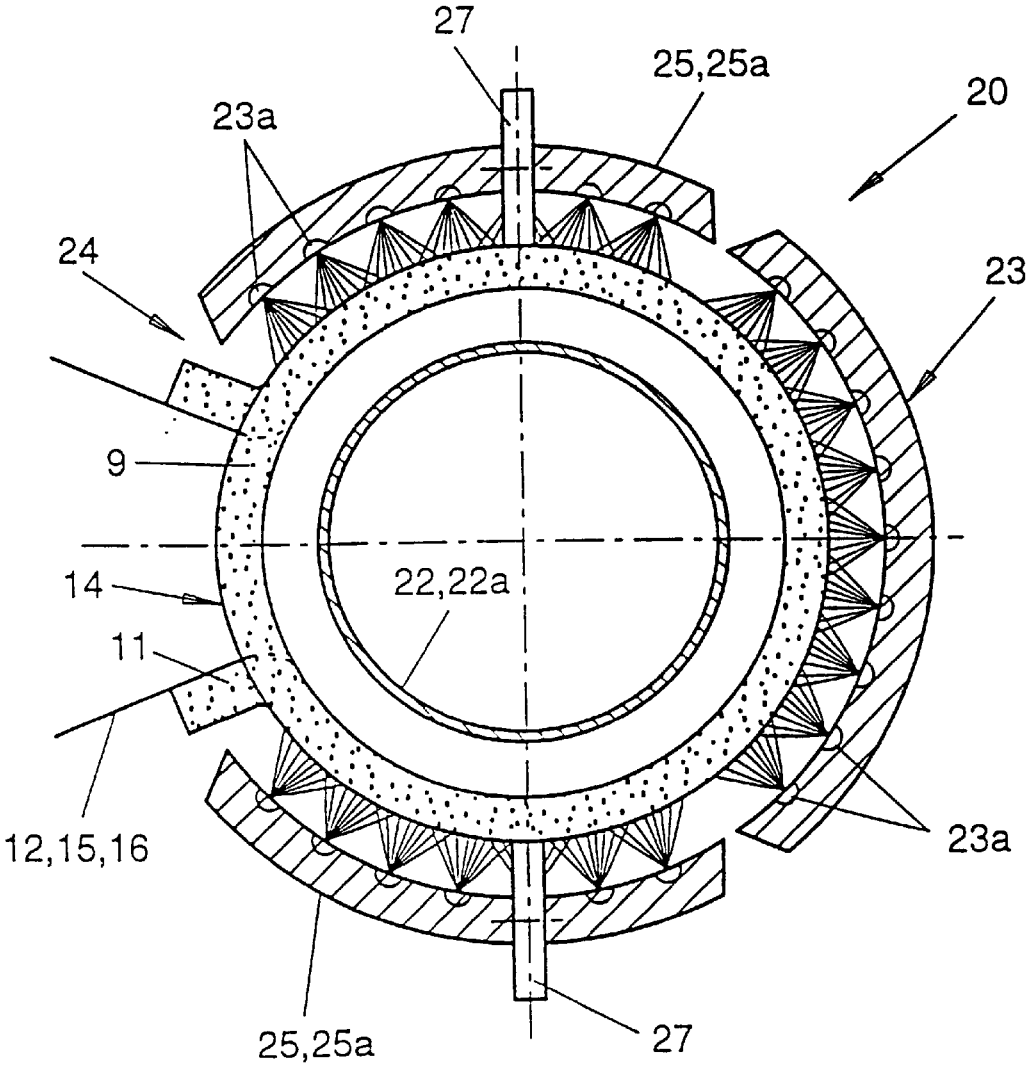
FIG. 7 is an end-on view of the arrangement of FIG. 6.

As FIGS. 6 and 7 clearly illustrate, the carrying arms 25 surround the suction tube 22*a* in the form of an axially symmetrical shell, which has a lateral slit-like clearance 24 for the air connection 12. The blowing nozzles 23*a* are preferably arranged at the end of the carrying arms 25 and are fed by suitable lines, which may also run, for example, through the interior of the carrying arms 25. There is also a similar design in the case of the variant with the covering 25*a*.

The blowing nozzles 23*a* are arranged in the region of the mouth of the suction tube 22*a* and are preferably located a little in front of this mouth. The fluid flow from the blowing nozzles 23*a* blows the detached residues directly in front of the mouth of the suction tube 22*a*, so that they can be sucked away immediately after detachment and sent to the disposal device 26.

The carrying arms 25 and the suction tube 22*a* are fastened on a suitable housing 21 of the filter cleaning apparatus 20 and protrude freely in the transporting direction 10 towards the travelling cleaner 1. For supporting the freely projecting carrying arms 25 or covering 25*a*, there may be provided slidable and/or rollable supporting elements 27, which rest on the filter casing 11. A centering and supporting effect can also be achieved by the blowing nozzles 23*a* and the air flow. For this purpose, it is recommendable to distribute the blowing nozzles 23*a* over the circumference, as far as possible uniformly and preferably axially symmetrically.

In the preferred embodiment, the blowing nozzles 23*a* are situated only at the end of the covering 25*a* or the carrying arms 25 and direct there a relatively closely confined fluid flow onto the filter casing 11. The overlapping of the areas of impingement on the filter 9 has the effect of producing a narrow annular area, which is closed apart from the clearance 24. As the travelling cleaner 1 progressively approaches the filter-cleaning apparatus 20, this fluid flow proceeds along the filter casing 11 and gradually cleans the latter zone by zone. The covering 25*a* or the carrying arms 25 reach around and cover the already cleaned regions of the filter and screen them from the outside.

In a modification of the exemplary embodiment shown, the filter-cleaning apparatus 20 may be integrated into the travelling cleaner 1. The blowing device 22 then has, for example, an independently movable and driven nozzle ring, which is moved on a suitable guide along the filter. The covering 25*a* may then for its part be movable, in particular extendable or telescopic, for example in the form of a corrugated bellows drawn along by the nozzle ring. The flushing fluid may be supplied via trailing lines. In this case, the compressed-air source 30*a* may, for example, be of external and stationary arrangement and be docked on by means of suitable couplings. Alternatively, it may be taken along on the travelling cleaner 1. Moreover, the suction-removal device 22 can manage without the suction tube 22*a*, in particular if there is a largely flow-impermeable covering 25*a*. The suction-removal device 22 then has only a simple suction connection or stationary suction stub on the filter chamber 8.

Alternatively, a conventional filter cartridge, which has at least one open end face connected to an air connection, may also be used and cleaned. In the case of this filter, the cleaning air enters axially and leaves again radially through the filter casing. The filter cartridge has an end-face and/or lateral mounting for fastening on the wall of the filter chamber 8. Provided in this mounting are suitable openings for the passing through of the blowing nozzles 23*a* and the carrying arms 25. In this case, there are in the circumferential direction greater spacings between the carrying arms 25 than in the case of the embodiment shown in FIG. 7.

In a further modification, the carrying arms 25 or the covering 25*a* may have further blowing nozzles 23*a* not only at the end but also at one or more points before the end. Equally, the suction tube 22*a* may also have a perforated casing instead of the closed casing. The filter-flushing then does not take place only in the suction tube mouth but also in the other tube regions, it being possible for the pressure and the strength of the air flow to be lower here.

Figure 8:
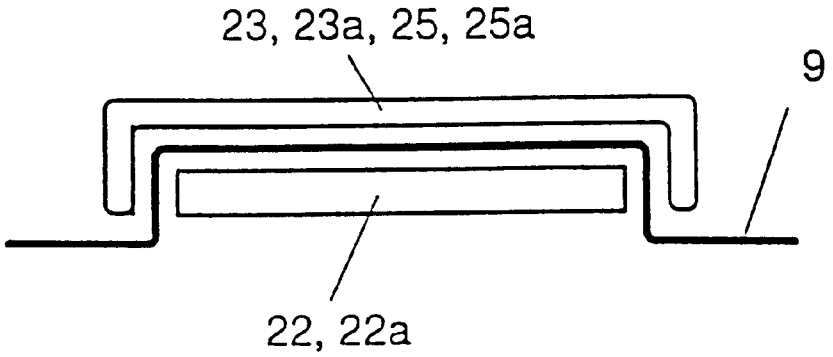
FIGS. 8–10 are views of different variants of the filter shape and of the adapted blowing and suction-removal device.
Figure 9:
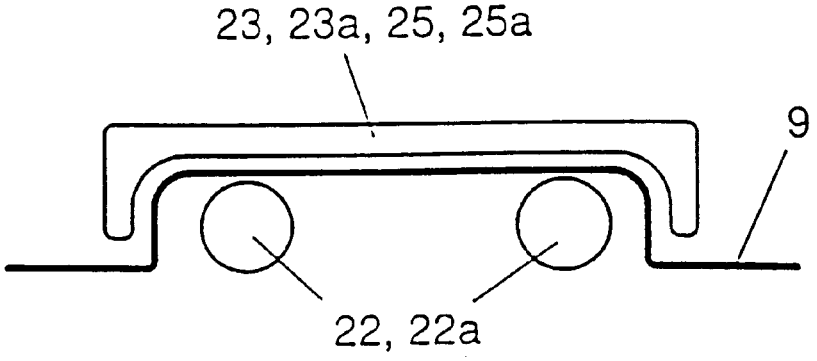
Figure 10:
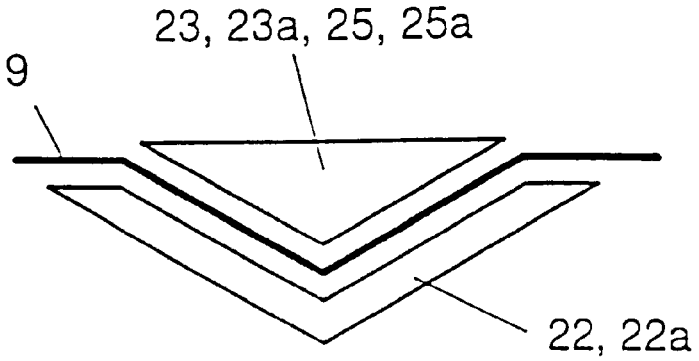

FIGS. 8 to 10 show variants of the shape of the filter 9 and of the blowing device 23 and suction removal device 22. Here too, there is mutual shape adaptation. In the exemplary embodiment of FIG. 8, the filter 9 is formed as a filter mat arched in an omegashaped manner. The suction-removal tube 22*a* is of a box-shaped design and is arranged in the hollow space under the filter arch. The blowing device 23, on the other band, is formed in a U-shaped manner and spans the said filter arch from above. The covering 25*a* or the carrying arms 25 and also the blowing nozzles 23*a* are also correspondingly shaped.

In FIG. 8, the corner regions of the filter arch are more sharply pronounced. In the variant of FIG. 9, the filter arch has smoother roundings. The spanning blowing device 23 is also correspondingly shaped. In this case, the suction-removal device 22 comprises two or more cylindrical suction-removal tubes 22*a*, which are arranged next to each other underneath the filter arch.

In the exemplary embodiment of FIG. 10, the filter 9 is bent in a V-shaped manner. The suction removal device 22, arranged underneath the filter 9, and the blowing device 23, lying above it, are also shaped accordingly.

Apart from the shapes shown, any other desired variants are possible, for example a filter shape corrugated in smooth waves or in triangles. Such structural shapes may be useful for enlarging the filter surface. The filter 9 may also be formed as a planar flat filter. In this case, the suction tube has, for example, the form of a flat and wide box, which is moved along underneath the filter mat. The carrying arms 25 and the blowing nozzles 23*a* are also formed such that they are correspondingly wide and flat.

Figure 11:
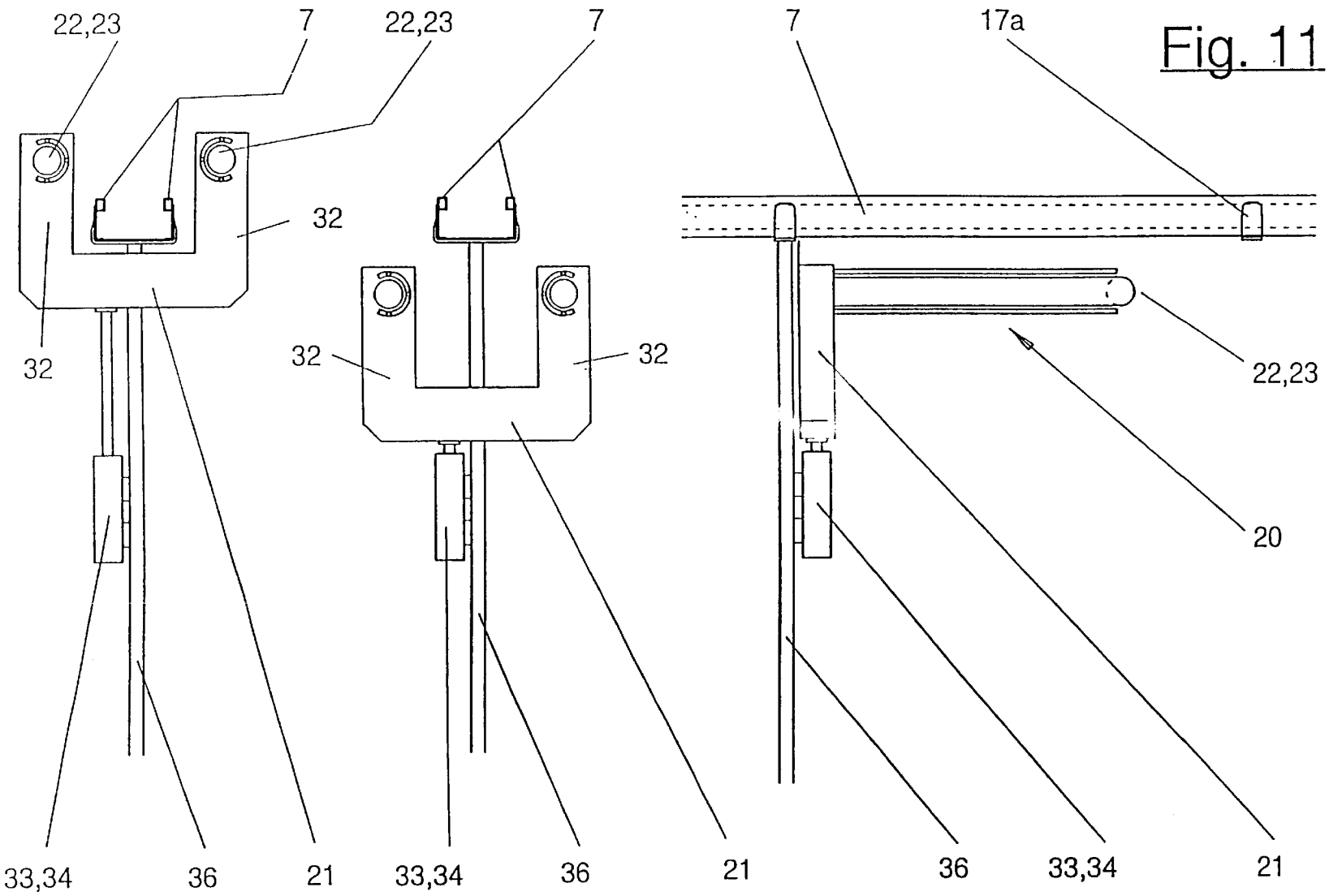
FIGS. 11–13 are views of different types of filter-cleaning apparatus.
Figure 12:
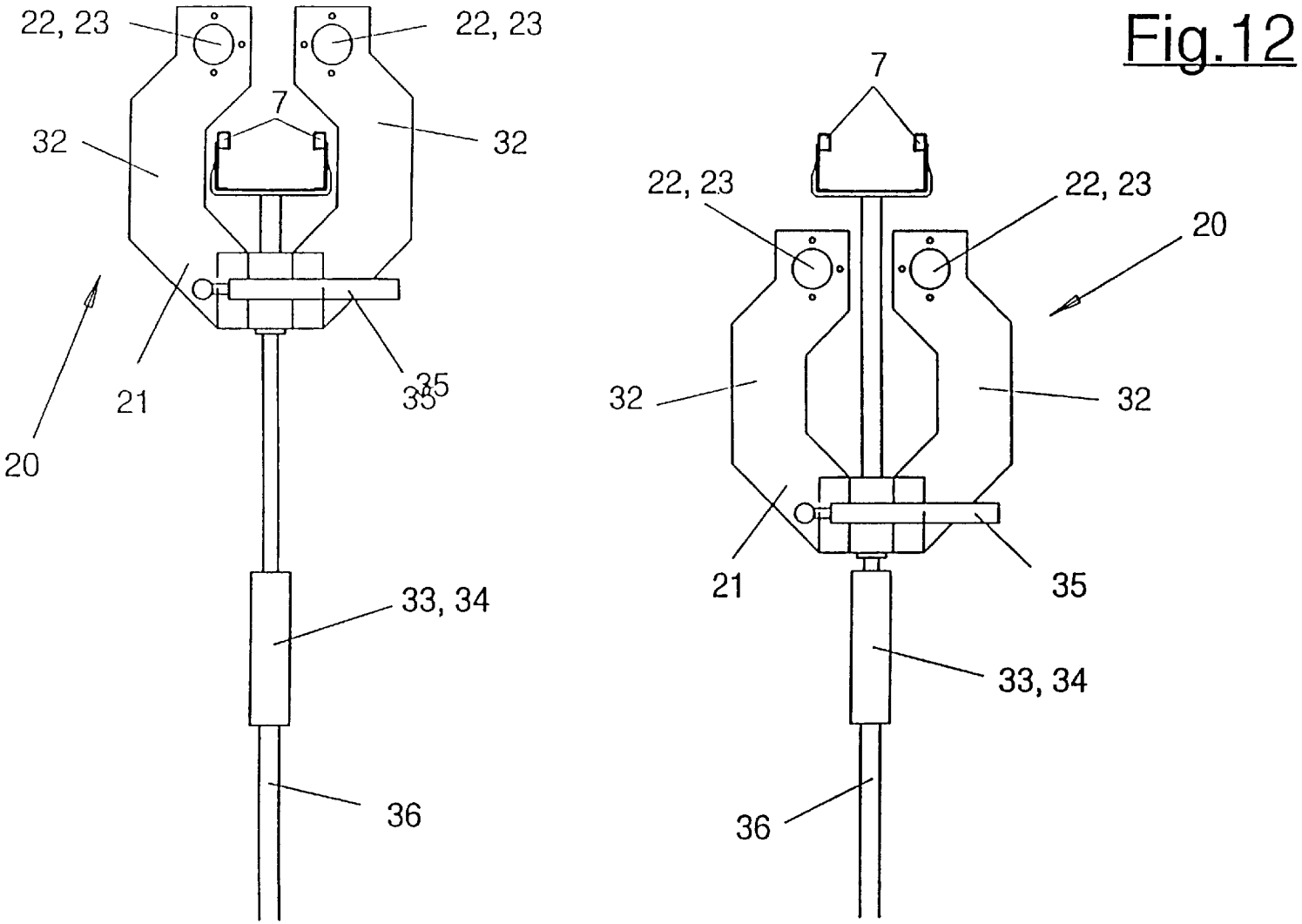
Figure 13:
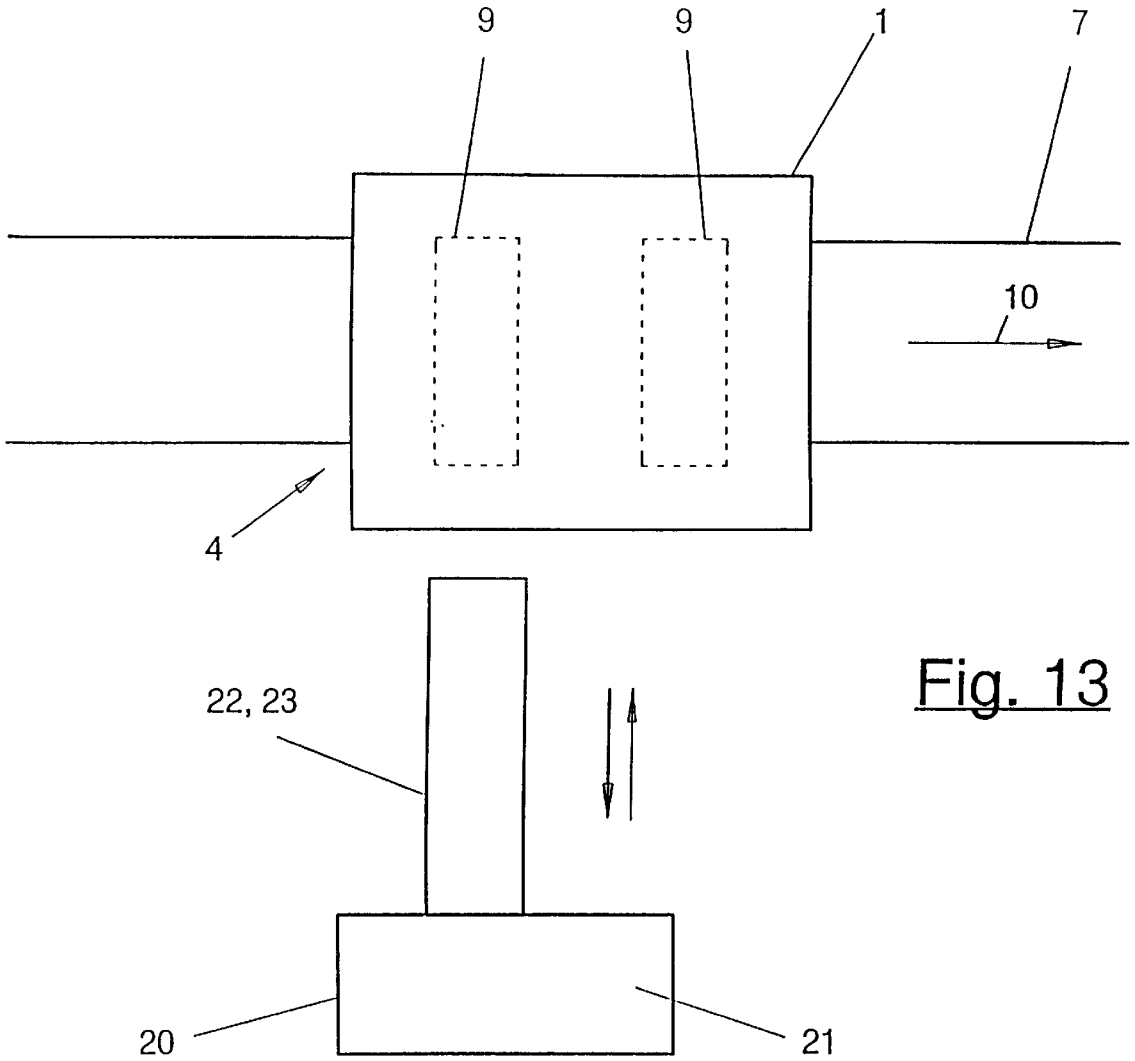

FIGS. 11 to 13 show variants of the external structural shape and arrangement of the filter-cleaning apparatus 20.

In the exemplary embodiment of FIG. 11, the filter-cleaning apparatus 20 is arranged at any desired point on the route of the transporting line 7 of the travelling cleaner 1. The transporting line 7 may be formed as an annularly closed track which extends, for example, over two rows of spinning or weaving machines. The filter-cleaning apparatus 20 is then arranged, for example, at the transitional point between the two rows of machines.

In contrast to the exemplary embodiment of FIG. 5, the filter-cleaning device 20 in FIGS. 11 to 13 is movably arranged transversely with respect to the transporting direction 10. In FIGS. 11 and 12, it is positioned underneath the rails 7 and can be adjusted into the path of movement of the travelling cleaner 1 upwards into the operating position and be withdrawn downwards into the position of rest. For this purpose, the housing 21 of the filter-cleaning apparatus 20 is arranged on a frame 36 such that it can run vertically and is brought into the various positions by means of an adjusting mechanism 33. In this embodiment, the housing 21 is designed in a U-shaped manner and has two rigid, upwardly projecting arms 32, which respectively have in the top region a blowing and suction-removal device 22, 23.

The adjusting mechanism 33 has in FIG. 11 a lifting drive 34, for example a pneumatic or hydraulic cylinder, which is fastened on the frame 36. The housing 21 is arranged on the piston. It may be additionally guided such that it can be moved in height on the frame 36.

In the lowered position of rest, the travelling cleaner 1 can travel over the filter-cleaning apparatus 20. In the operating position, the filter-cleaning apparatus 20 assumes a similar position as in the exemplary embodiment of FIG. 5, the cleaning operation being essentially the same.

The exemplary embodiment of FIG. 12 shows a further modification of FIG. 11. The housing 21 is of a movable design here, it being possible to change the width of the housing. This is possible, for example, by a jointed connection of the housing arms 32, which in the position of rest are drawn together. The smaller housing width can then be travelled over more easily by the travelling cleaner 1. In the operating position, the housing arms 32 are spread in a way analogous to FIG. 11. For the movement of the housing arms 32, the adjusting mechanism 33 additionally has a suitable drive 35, for example a swivel drive with a pneumatic or hydraulic cylinder.

In the exemplary embodiment of FIGS. 11 and 12, the blowing and suction-removal devices 22, 23 are aligned along the transporting direction 10. The filters 9 also extend in this direction. In a modification of the embodiment shown, the position of rest may also be assumed above or to the side of the rails 7.

FIG. 13 shows a further modification with a laterally arranged filter-cleaning apparatus 20. In this exemplary embodiment, however, the filters 9 and the blowing and suction-removal devices 22, 23 are also aligned transversely with respect to the transporting direction 10. In this embodiment, the filter-cleaning apparatus 20 also has an additional transverse mobility and a suitable drive in order to adjust the blowing and suction-removal device 22, 23 up to the travelling cleaner 1 and withdraw it again. The filter-cleaning apparatus 20 may in this case be arranged to the side and at the same height next to the travelling cleaner 1.

Alternatively, an arrangement underneath or above the travelling cleaner 1 is also possible, however, the filters 9 being correspondingly aligned vertically. In principle, the alignment of the filters 9 and the arrangement and mobility of the filter-cleaning apparatus 20 may be as desired, i.e. may also be oblique to the travelling direction 10.

In the case of the embodiment shown in FIG. 13, a single suction-removal and blowing device 22, 23 suffices for the cleaning of a plurality of filters 9. The filters 9 are in this case cleaned one after the other, the travelling cleaner 1 being moved forward or back a little for exchanging filters.

The travelling cleaner 1 has a suitable, preferably programmable and computerized control, which automatically initiates and controls the cleaning operations. In this case, if appropriate, the filter-cleaning apparatus 20 may also be controlled at the same time. On the rails 7 there are, for example, switching elements 17*a* in the form of contact switches, contactless sensors or the like, which signal the arrival of the travelling cleaner 1 and make the filter-cleaning apparatus 20 move out of the position of rest into the operating position.

By means of suitable measuring elements, for example pressure sensors, the filter soiling can be established by a drop in pressure or the like and the cleaning operation initiated. The control also controls fully automatically the closure movements, the transporting advancement and the other movements and sequences involved in the filter cleaning.

The features of the embodiments shown and described may be combined or interchanged in any desired way for further modifications of the invention.

While specific embodiments of the invention have been shown and described in detail to illustrate the application of the principles of the invention, it will be understood that the invention may be embodied otherwise without departing from such principles.

I claim:

1. A travelling cleaner for textile machines, the cleaner comprising:

a blowing and sucking device;

a filter device with an interior in communication with said blowing and sucking device, said filter device defining an air connection communicating said interior of said filter device with an exterior of said filter device;

a tubular filter cartridge defining a casing opening passing radially through said filter cartridge, said filter cartridge being positioned in said filter device with said casing opening in communication with said air connection of said filter device to form a suction path leading from said air connection, radially into an interior of said filter cartridge through said casing opening, radially out of said filter cartridge through said filter cartridge while being filtered, and into said interior of said filter device.

2. The travelling cleaner according to claim 1, wherein:

said casing opening is shaped as a longitudinally extending slit.

3. The travelling cleaner according to claim 1, wherein the casing opening extends over a majority part of the filter length.

4. The travelling cleaner according to claim 1, wherein said air connection has an opening width of about 35 mm or more.

5. The travelling cleaner according to claim 1, further comprising a mounting acting laterally on said filter device and for supporting the filter cartridge.

6. The travelling cleaner according to claim 5, wherein said mounting is arranged in a region of the air connection.

7. The travelling cleaner according to claim 1, wherein the air connection has a funnel-shaped stub connected to a supporting shell for the filter cartridge.

8. The travelling cleaner according to claim 7, further comprising a clamping device, wherein the filter cartridge is slipped over the stub by means of the casing opening and is detachably fastened by said clamping device.

9. The travelling cleaner according to claim 7, wherein the stub is connected to the filter cartridge and is detachably fastened on a wall of the filter device.

10. The travelling cleaner according to claim 1, wherein said filter cartridge is aligned in a transporting direction of the travelling cleaner.

11. The travelling cleaner according to claim 1, wherein said filter cartridge is closed at end faces.

12. The travelling cleaner according to claim 1, wherein said filter device has in a region of one end face of said filter cartridge, a closure which exposes an access opening for the entry of a filter-cleaning apparatus.

13. The travelling cleaner according to claim 12, wherein said closure has an end-face shaped support for said filter cartridge.

14. The travelling cleaner according to claim 1, further comprising a filter-cleaning apparatus having a suction-removal device and a blowing device, which together act on the filter cartridge.

15. The travelling cleaner according to claim 14, wherein said blowing device and said suction-removal device are arranged on opposite sides of said filter cartridge, the blowing device being on a clean side of the filter and the suction-removal device being on a soiled side.

16. The travelling cleaner according to claim 14, wherein:

one of said blowing device and the suction-removal device are arranged relatively movably with respect to said filter cartridge.

17. The travelling cleaner according to claim 14, wherein said blowing device has one or more narrow blowing nozzles for forming an intense fluid jet.

18. The travelling cleaner according to claim 14, wherein:

a blowing pressure is stronger than a suction-removal negative pressure.

19. The travelling cleaner according to claim 14, wherein:

one of the blowing device and the suction-removal device are complementary to the filter shape and cover(s) or travel(s) essentially completely over a filter area of the filter cartridge.

20. The travelling cleaner according to claim 14, wherein said blowing device is connected to a dedicated compressed-air source.

21. The travelling cleaner according to claim 14, wherein said blowing device has a rigid or extendable covering spanning said filter.

22. The travelling cleaner according to claim 14, wherein said suction-removal device is connectable to a disposal device for filter residues.

23. The travelling cleaner according to claim 14, wherein said filter-cleaning apparatus is integrated into the travelling cleaner.

24. The travelling cleaner according to claim 14, wherein said filter-cleaning apparatus is arranged outside the travelling cleaner, the travelling cleaner and the filter-cleaning apparatus being movable in relation to each other.

25. The travelling cleaner according to claim 24, wherein said filter-cleaning apparatus is mounted and driven movably transversely with respect to a travelling direction of the travelling cleaner.

26. The travelling cleaner according to claim 25, wherein said filter-cleaning apparatus has a single suction-removal and blowing device for a plurality of said filter cartridges.

27. The travelling cleaner according to claim 24, wherein said filter-cleaning apparatus has a plurality of said suction-removal and blowing devices, which are arranged movably in relation to one another.

28. The travelling cleaner according to claim 24, wherein said suction-removal device has at least one suction-removal tube which can be introduced into the filter cartridge.

29. The travelling cleaner according to claim 28, wherein said blowing nozzles surround the suction-removal tube on the outside with radial spacing.

30. The travelling cleaner according to claim 18, wherein said blowing nozzles are arranged on one of carrying arms and a covering, extending along the suction-removal tube.

31. The travelling cleaner according to claim 14, wherein said blowing nozzles are arranged in a region of a mouth of said suction-removal tube.

32. The travelling cleaner according to claim 30, wherein said blowing nozzles and the carrying arms or the covering are arranged in a shell shape, which has a clearance for the air connection.

33. The travelling cleaner according to claim 30, wherein:

one of slidable and rollable supporting elements are arranged on one of the carrying arms and the covering for supporting said blowing nozzles on said filter cartridge.

* * * * *